United States Patent [19]

Krumphold et al.

[11] 4,191,597

[45] Mar. 4, 1980

[54] HEAT TREATMENT FOR MARTENSITE CURED ALLOYS

[75] Inventors: Ralf Krumphold, Dresden; Heinrich Paul, Pappritz, both of Fed. Rep. of Germany; Juri Busalow; Iwan Kopjew, both of Moscow, U.S.S.R.

[73] Assignees: Akademie der Wissenschaften der DDR, Berlin-Adlershof, Fed. Rep. of Germany; Akademie der Wissenschaften der UdSSR, Moscow, U.S.S.R.

[21] Appl. No.: 973,074

[22] Filed: Dec. 22, 1978

[51] Int. Cl.[2] ..... C21D 9/52

[52] U.S. Cl. ..... 148/12 B; 148/12.4

[58] Field of Search ..... 148/12.4, 12 B

[56] References Cited

U.S. PATENT DOCUMENTS

| | | | |
|---|---|---|---|
| 4,017,338 | 4/1977 | Kozak et al. | 148/12 B |
| 4,087,295 | 5/1978 | Sargent et al. | 148/12 B |
| 4,106,957 | 8/1978 | Tournoy | 148/12 B |
| 4,108,695 | 8/1978 | Paulitsch et al. | 148/12 B |
| 4,146,411 | 3/1979 | Dewsnap et al. | 148/12 B |

*Primary Examiner*—W. Stallard

*Attorney, Agent, or Firm*—Michael J. Striker

[57] ABSTRACT

A process for improving the mechanical properties of martensite curred alloys comprising a cold mechanical working, a heat treatment within specified parameters, and a rapid cooling below 400° C. A continuous process is described which results in material with improved plasticity properties.

4 Claims, No Drawings

HEAT TREATMENT FOR MARTENSITE CURED ALLOYS

BACKGROUND OF THE INVENTION

The invention is in the field of metallurgy and specifically concerns a novel heat treatment process for the improvement of the mechanical properties of martensite cured alloys for use in the preparation of temperature-withstanding wires and straps for use as reinforcement components in metallurgical "solid solutions" or as wire cables in high-temperature media.

It is well known in the art to wind up wires made from the martensite-cured alloys after cold-drawing and then to subject the thus obtained bundles or spools to a heat treatment in order to increase the durability of the wire. The disadvantage of the prior art lies in the fact that only a discontinuous preparative process is possible. Further, the wires are too brittle for many uses, as the above process only achieves the production of a wire with a breaking tension elongation of 0.5%.

DESCRIPTION OF THE INVENTION

The goal of the present invention is to devise a method for continuous preparation of the wires and bands and to improve the plasticity properties of the wires, especially the maintenance of higher strength at high temperatures. The goal is achieved in the present invention through subjecting the alloy to a cold deformation with the deformation degree greater than 30% and a subsequent heat treatment.

In the heat treatment, the following conditions must be met over the total cross-section of the portion of the alloy within the heating zone:

$$\Delta T/\Delta t = 0.9 Tgl./t_A \geqq 50° \text{ C./sec}, \quad (1)$$

(2) 20 sec > tgl > 0.1 sec, and (3) $tgl = t_G - t_A$, where $\Delta T/\Delta t$ = mean rate of heating Tgl = annealing temperature $t_G$ = total duration of thermal treatment $t_A$ = total heating time tgl = total annealing time.

After the heating the alloy is immediately cooled for maximally 5 seconds or less below 400° C. A molybdenum-maraging-steel is preferably used as the martensite-cured alloy.

The realization of the invention is described in the following example:

A molybdenum-maraging-steel alloy of the following composition: 14% Mo, 18% Co, 8% Ni, 0.4% Mn, 59.6% iron is rolled in a heat process to the shape of a wire having a diameter of 9 mm which is then drawn down in a cold process to a diameter of 0.1 mm. Without interruption the wire is passed from the last cold-drawing die through an oven where it is warmed by indirect heating to a temperature of around 800° C. With the parameters of a speed of passage through the oven of 60 mm/sec and an annealing zone length of 200 mm one achieves a total working time for the thermal treatment of $t_G = 3.33$ sec. After the passage of the wire out of the oven it is cooled with the help of an air spray below 400° C. The wire so treated exhibits a tensile strength $T_B$ = of 360 kp/mm$^2$ ($353 \times 10^6$ dyn/mm$^2$) and a breaking tension elongation of 3%. Further, the wire retains these properties over short periods when exposed to temperatures up to 700° C. and for longer periods of exposure to temperatures up to 450° C.

It will be understood that each of the elements described above, or two or more together, may also find a useful application in other types of treatment of martensite cured alloys, differing from the types described above.

While the invention has been illustrated and described as embodied in treatment of martensite cured alloys, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for improving the mechanical properties of martensite-cured alloys, comprising the steps of subjecting the alloys to a cold deformation with the deformation degree greater than 30%;

thereafter subjecting the alloys to a heat treatment, wherein the following conditions must be met over the total cross-section of the portion of the alloy within the heating zone:

$$\Delta T/\Delta t = 0.9\ Tgl/t_A \geqq 50° \text{ C./sec}, \quad (1)$$

(2) 20 sec > tgl > 0.1 sec, and (3) $tgl = t_G - t_A$, where $\Delta T/\Delta t$ = mean rate of heating Tgl = annealing temperature $t_G$ = total duration of the thermal treatment $t_A$ = total heating time tgl = total annealing time; and rapidly cooling the alloys below 400° C. for maximally 5 seconds or less.

2. The process of claim 1, wherein the cooling is effected by means of an air spray.

3. The process of claim 1, wherein the cold mechanical working, the heat treatment and the cooling are performed continuously.

4. The process of claim 1, wherein the martensite-cured alloy is molybdenum-maraging steel.

* * * * *

UNITED STATES PATENT AND TRADEMARK OFFICE

CERTIFICATE OF CORRECTION

PATENT NO. : 4,191,597

DATED : March 4, 1980

INVENTOR(S) : Ralf Krumphold et al

It is certified that error appears in the above-identified patent and that said Letters Patent are hereby corrected as shown below:

In the heading, the country of the inventors Ralf Krumphold and Heinrich Paul should read -- German Democratic Republic --, and the country of the assignee Akademie der Wissenschaften der DDR should read -- German Democratic Republic --.

Signed and Sealed this

*Twelfth* Day of *August 1980*

[SEAL]

*Attest:*

SIDNEY A. DIAMOND

*Attesting Officer*

*Commissioner of Patents and Trademarks*